US009934722B2

(12) United States Patent
Kim

(10) Patent No.: US 9,934,722 B2
(45) Date of Patent: Apr. 3, 2018

(54) LIGHT-EMITTING DIODE DISPLAY HAVING A MINIMIZED VOLTAGE DROP DEVIATION ON A DRIVING POWER LINE

(71) Applicant: Samsung Display Co., Ltd., Yongin, Gyeonggi-Do (KR)

(72) Inventor: Ki Wook Kim, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 232 days.

(21) Appl. No.: 14/605,254

(22) Filed: Jan. 26, 2015

(65) Prior Publication Data

US 2016/0020174 A1 Jan. 21, 2016

(30) Foreign Application Priority Data

Jul. 18, 2014 (KR) ..... 10-2014-0090795

(51) Int. Cl.
*G09G 3/30* (2006.01)
*G09G 3/3233* (2016.01)

(52) U.S. Cl.
CPC ... *G09G 3/3233* (2013.01); *G09G 2300/0426* (2013.01); *G09G 2320/0223* (2013.01); *G09G 2320/0233* (2013.01)

(58) Field of Classification Search
CPC ..... G09G 1/005; G09G 2330/00–2330/028; G09G 2300/0439–2300/0895; G09G 3/32–3/3291; G09G 3/364–3/3644; G09G 3/3666
See application file for complete search history.

(56) References Cited

U.S. PATENT DOCUMENTS 8,575,628 B2 11/2013 Kim et al.
2005/0219164 A1 10/2005 Tanada
2008/0024529 A1* 1/2008 Asano ..... G09G 3/3233 345/697
2011/0128268 A1 6/2011 Kim et al.
2012/0113069 A1* 5/2012 Kwon ..... G09G 3/3611 345/204
2014/0368416 A1* 12/2014 Gu ..... G09G 3/3233 345/78

FOREIGN PATENT DOCUMENTS

JP 2004-356052 A 12/2004
KR 10-2011-0061278 A 6/2011
KR 10-2011-0131973 A 12/2011

* cited by examiner

*Primary Examiner* — Sanghyuk Park
(74) *Attorney, Agent, or Firm* — Knobbe Martens Olson & Bear LLP

(57) ABSTRACT

A light emitting element display device is disclosed. In one aspect, the display includes a first pixel column including a plurality of pixels, a second pixel column including a plurality of pixels disposed substantially parallel to the first pixel column, a first transmission line between the first and second pixel columns, a second transmission line disposed substantially parallel to the first transmission line, and a power supply connected to any one of the first and second transmission lines so as to supply driving power. The first and second transmission lines may be connected to each other, at least one of the pixels of the first pixel column may be connected to the second transmission line, and at least one of the pixels of the second pixel column may be connected to the first transmission line.

15 Claims, 15 Drawing Sheets

LIGHT-EMITTING DIODE DISPLAY HAVING A MINIMIZED VOLTAGE DROP DEVIATION ON A DRIVING POWER LINE

CROSS-REFERENCE TO RELATED APPLICATION

This application claims priority to and the benefit of Korean Patent Application No. 10-2014-0090795, filed on Jul. 18, 2014, with the Korean Intellectual Property Office, the disclosure of which is incorporated herein in its entirety by reference.

BACKGROUND OF THE INVENTION

Field

The described technology generally relates to a light emitting element display device.

Description of the Related Art

Display devices include a plurality of pixels provided in an area defined by a black matrix or a pixel defining layer. Types of display devices include, for example, liquid crystal displays (LCDs), light emitting element display devices, electrophoretic displays, and the like.

SUMMARY OF THE INVENTION

One inventive aspect is a light emitting element display device having a driving power line of which a structure allows a deviation of IR drop or voltage drop to be minimized.

Another aspect is a light emitting element display device that includes a first pixel column including a plurality of pixels, a second pixel column including a plurality of pixels disposed substantially parallel to the first pixel column, a first transmission line between the first and second pixel columns, a second transmission line disposed substantially parallel to the first transmission line, and a power supply connected to any one of the first and second transmission lines so as to supply driving power. The first and second transmission lines can be connected to each other, at least one of the pixels of the first pixel column can be connected to the second transmission line, and at least one of the pixels of the second pixel column can be connected to the first transmission line.

The pixels of the first pixel column can be alternately connected to the first and second transmission lines.

The pixels of the second pixel column can be alternately connected to the first and second transmission lines.

The first pixel column can include a plurality of pixels displaying the same color.

The second pixel column can include a plurality of pixels displaying the same color.

The first pixel column can include a plurality of pixels displaying different colors.

The first pixel column can include a first pixel connected to the first transmission line and a second pixel connected to the second transmission line, and the first and second pixels can display different colors from each other.

The second pixel column can include a plurality of pixels displaying different colors.

The second pixel column can include a first pixel connected to the first transmission line and a second pixel connected to the second transmission line, and the first and second pixels can display different colors from each other.

The first pixel column can be connected to the first transmission line along a row and can include two or more kinds of pixels displaying different colors.

The second pixel column can be connected to the second transmission line along a row and can include two or more kinds of pixels displaying different colors.

Another aspect is a light emitting element display device that includes a pixel column including a plurality of pixels, first and second transmission lines connected to each other, and a power supply connected to any one of the first and second transmission lines so as to supply driving power. At least one of the plurality of pixels can include first and second light emitting elements, the first light emitting element can be connected to the first transmission line, and the second light emitting element can be connected to the second transmission line.

Another pixel of the plurality of pixels can include third and fourth light emitting elements, the third light emitting element can be connected to the second transmission line, and the fourth light emitting element can be connected to the first transmission line.

Another aspect is a light emitting element display device that exhibits the following effects. In the above display, the pixels are configured to display the same color. The above display further comprises a bent portion connecting ends of the first and second transmission lines to each other.

Another aspect is a driving power line that includes a first transmission line configured to transmit driving voltages supplied from a power supply to some first pixels and some second pixels and a second transmission line configured to transmit the driving voltages applied to the first transmission line to the other first pixels and the other second pixels. Therefore, IR drop of a first driving voltage in each horizontal line of a display unit occurs at the same level, thereby reducing low image quality.

DETAILED DESCRIPTION OF THE PREFERRED EMBODIMENT

Figure 1:
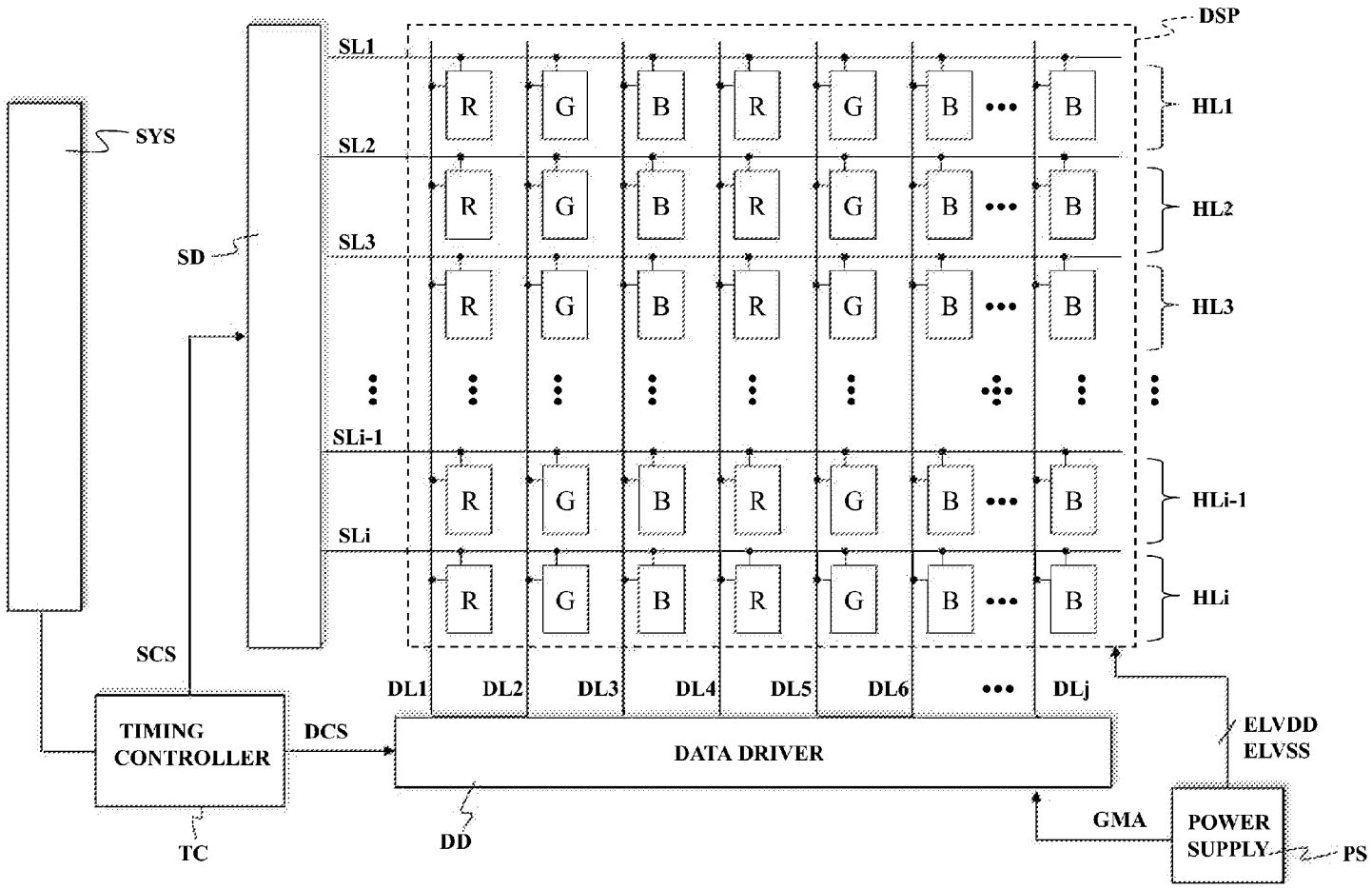
FIG. 1 is a view illustrating a light emitting element display device according to an embodiment.

Among display devices, light emitting element display devices include a driving power line that transmits a driving voltage to drive light-emitting diode elements included in pixels. When the driving voltage is applied to an end portion of the driving power line, voltage drop of the driving voltage applied to a pixel close to the end portion of the driving power line is relatively low. On the other hand, the voltage drop of the driving voltage applied to a pixel far from the end portion of the driving power line is relatively high. Therefore, as the driving power line becomes longer with a larger area of display devices, voltage drop between the pixels increases, which result in low image quality.

Hereinafter, embodiments of the described technology will be described in more detail with reference to the accompanying drawings.

Although the described technology can be modified in various manners and has several embodiments, specific embodiments are illustrated in the accompanying drawings and will be mainly described in the specification. However, the scope of the described technology is not limited to the specific embodiments and should be construed as including all the changes, equivalents, and substitutions included in the spirit and scope of the described technology.

In the specification, when a first element is referred to as being "connected" to a second element, the first element can be directly connected to the second element or indirectly connected to the second element with one or more intervening elements interposed therebetween. The terms "comprises," "comprising," "includes," and/or "including," when used in this specification, can specify the presence of stated features, integers, steps, operations, elements, and/or components, but do not preclude the presence or addition of one or more other features, integers, steps, operations, elements, and/or components.

Although the terms "first," "second," and "third" and the like can be used herein to describe various elements, these elements should not be limited by these terms. These terms can be used to distinguish one element from another element. Thus, "a first element" could be termed "a second element" or "a third element," and "a second element" and "a third element" can be termed likewise without departing from the teachings herein. The description of an element as a "first" element cannot require or imply the presence of a second element or other elements. The terms "first," "second," etc. can also be used herein to differentiate different categories or sets of elements. For conciseness, the terms "first," "second," etc. can represent "first-type (or first-set)," "second-type (or second-set)," etc., respectively.

Like reference numerals can refer to like elements in the specification. In this disclosure, the term "substantially" includes the meanings of completely, almost completely or to any significant degree under some applications and in accordance with those skilled in the art.

FIG. 1 is a view illustrating a light emitting element display device according to an embodiment.

As illustrated in FIG. 1, the light emitting element display device according to an embodiment includes a display panel DSP, a system SYS, a timing controller TC, a data driver DD, a scan driver SD, and a power supply PS.

The display panel DSP can include i×j pixels (R, G, and B), i scan lines SL1 to SLi, and j (i and j are natural numbers greater than 1) data lines DL1 to DLj. In this case, first to $i^{th}$ scan signals can be respectively applied to the first to $i^{th}$ scan lines SL1 to SLi, and data voltages can be respectively applied to the first to $j^{th}$ data lines DL1 to DLj. Although not illustrated in FIG. 1, the display panel DSP can further include at least one first driving power line configured to transmit a first driving voltage to the i×j pixels and at least one second driving power line configured to transmit a second driving voltage to the i×j pixels. Detailed structure and functions of the power supply lines will be described below.

The pixels (R, G, and B) can be disposed on the display panel DSP in a matrix form. The pixels (R, G, and B) can be classified into three categories: a red pixel R that displays a red color; a green pixel G that displays a green color; and a blue pixel B that displays a blue color. The red, green, and blue pixels (R, G, and B), which are adjacent to each other in a substantially horizontal direction, can form a unit pixel that displays a combination of colors. J number of pixels (hereinafter referred to as "the $n^{th}$ horizontal line pixels") disposed along the $n^{th}$ horizontal line, where n is any one selected from 1 to i, can be respectively electrically connected to the first to $j^{th}$ data lines DL1 to DLj. The $n^{th}$ horizontal line pixels can be electrically connected in common to the $n^{th}$ scan line. Accordingly, the $n^{th}$ horizontal line pixels can receive in common the $n^{th}$ scan line. That is, the j pixels disposed on the same horizontal line can be all supplied with the same scan signal, but pixels on different horizontal lines can be supplied with different scan signals. In some embodiments, red and green pixels R and G disposed on a first horizontal line HL1 are all supplied with a first scan signal, whereas red and green pixels R and G disposed on a second horizontal line HL2 are supplied with a second scan signal that has a different timing than the first scan signal.

The system SYS can output a vertical synchronization signal, a horizontal synchronization signal, a clock signal, and image data through a low voltage differential signaling (LVDS) transmitter included in a graphics controller and an interface circuit included in the system SYS. The vertical synchronization signal, the horizontal synchronization signal, and the clock signal output by the system SYS can be supplied to the timing controller TC. The image data sequentially output by the system SYS can also be supplied to the timing controller TC.

The timing controller TC can generate a data control signal DCS and a scan control signal SCS utilizing the vertical synchronization signal, the horizontal synchronization signal, and the clock signal input to the timing controller TC. The timing controller TC can supply the data control signal DCS to a data driver DD and a scan control signal SCS to a scan driver SD.

The data driver DD can sample the image data based at least in part on the data control signal DCS from the timing controller TC. The data driver DD can then latch the sample image data falling into one horizontal line every horizontal time and supply the latched image data to the data lines DL1 to DLj. For example, the data driver DD converts the image data from the timing controller TC into analog signals (data voltages) using a gamma voltage GMA input from the power supply PS so as to supply the analog signals to the data lines DL1 to DLj.

The scan driver SD can output the first to $i^{th}$ scan signals sequentially based at least in part on the scan control signal SCS from the timing controller TC. The $n^{th}$ horizontal line pixels can be controlled based at least in part on the $n^{th}$ scan signal. The $n^{th}$ scan signal can be a pulse that is maintained in an active state during an $n^{th}$ horizontal time of every frame and that is maintained in an inactive state during the other time. All i number of scan signals can be a pulse in substantially the same form, but the scan signals can be different from each other temporally in terms of an output time. The active state of signals including the scan signal can be a state that can turn on a switching element receiving the signals, and the inactive state of signals can be a state that can turn off a switching element receiving the signals. The first to $i^{th}$ scan signals can have a voltage of about 20V in the active state and can have a voltage of about −5V in the inactive state.

The power supply PS can generate power signals including a gamma voltage GMA, a first driving voltage ELVDD, and a second driving voltage ELVSS. Thus, the power supply PS can include a gamma generating circuit that generates the gamma voltage GMA, a first driving power circuit that generates the first driving voltage ELVDD, and a second driving power circuit that generates the second driving voltage ELVSS. The first driving voltage ELVDD generated from the first driving power circuit can be supplied to pixels through at least one first driving power line and the second driving voltage ELVSS generated from the second driving power circuit can be supplied to pixels through at least one second driving power line.

Each pixel (R, G, and B) can have the following circuit configurations, and thus the circuit configuration of the pixels (R, G, and B) can be substantially the same. Hereinafter, the circuit configuration of the $n^{th}$ pixel will be described representatively.

Figure 2:
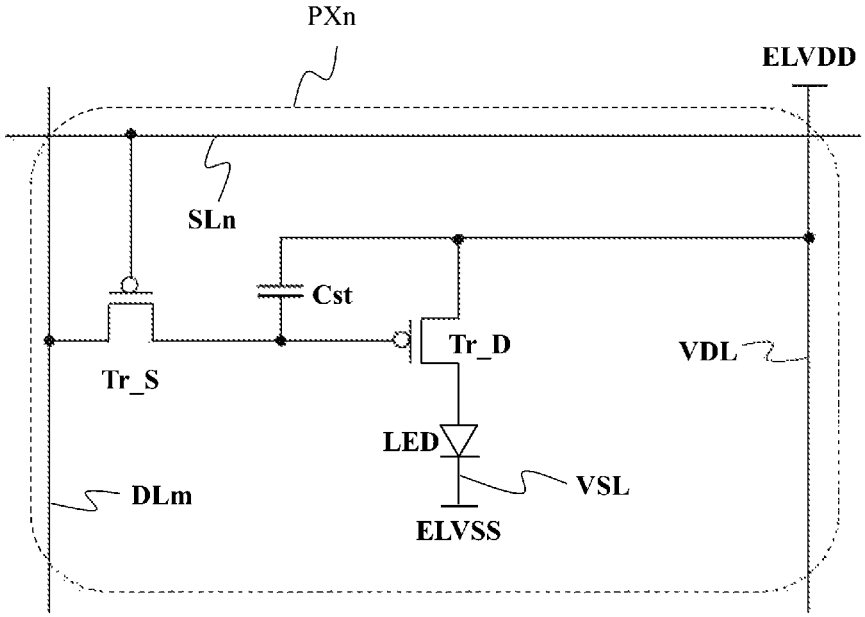
FIG. 2 is a view illustrating a circuit configuration of the $n^{th}$ pixel according to an embodiment.

FIG. 2 is a view illustrating the circuit configuration of the $n^{th}$ pixel according to an embodiment.

The $n^{th}$ pixel PXn can include a driving switching element Tr_D, a data switching element Tr_S, a storage capacitor Cst, and a light emitting element LED as illustrated in FIG. 2.

The driving switching element Tr_D can be controlled based at least in part on signals applied to a gate electrode thereof. The driving switching element Tr_D can be electrically connected between a first driving power line VDL that transmits the first driving voltage ELVDD and an anode of the light emitting element LED. The driving switching element Tr_D can adjust density of a driving current, which flows from the first driving power line VDL to a second driving power line VSL, based at least in part on the size of a signal applied to its own gate electrode.

The data switching element Tr_S can be controlled based at least in part on the $n^{th}$ scan signal from the $n^{th}$ scan line SLn. The data switching element Tr_S can be electrically connected between the $m^{th}$ data line DLm and the gate electrode of the driving switching element Tr_D.

The storage capacitor Cst can be electrically connected between the gate electrode of the driving switching element Tr_D and the anode An so as to store signals applied to the gate electrode of the driving switching element Tr_D.

The light emitting element LED can emit light based at least in part on a driving current supplied through the driving switching element Tr_D. Thus, brightness of the light emission can vary depending on the magnitude of the driving current. The anode of the light emitting element LED can be electrically connected to a drain electrode (or source electrode) of the driving switching element Tr_D. A cathode of the light emitting element LED can be electrically connected to the second driving power line VSL. An organic light emitting diode (OLED) can be used as the light emitting element LED.

Hereinafter, a connection between pixels and the first driving power line VDL will be described with reference to FIGS. 3 and 4.

Figure 3:
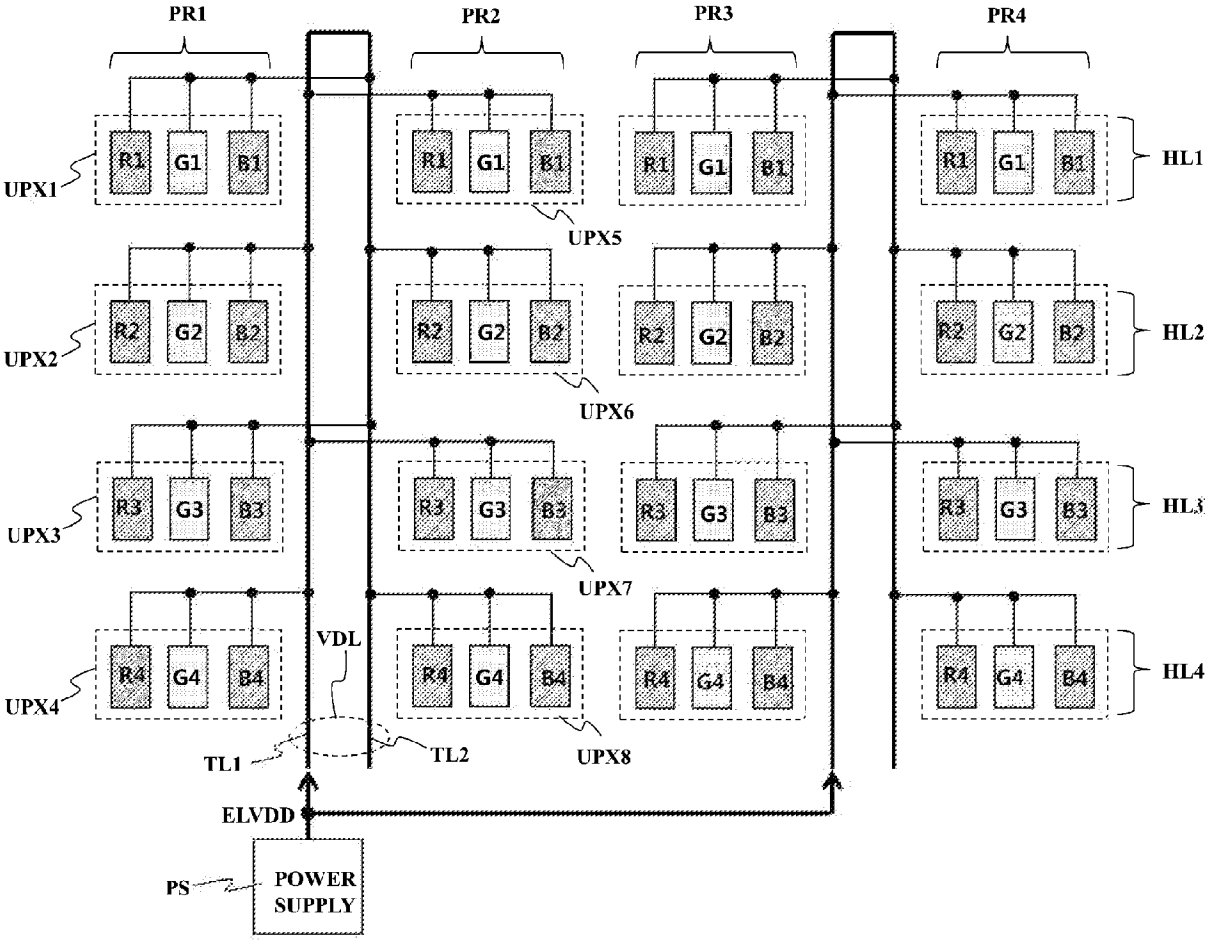
FIG. 3 is a view illustrating a connection between pixels illustrated in FIG. 1 and a first driving power line according to a first embodiment.

FIG. 3 is a view illustrating a connection between pixels illustrated in FIG. 1 and the first driving power line according to a first embodiment. FIG. 3 illustrates when the total number of horizontal lines of a display area is four and the total number of pixel columns is four. The numbers specified in FIG. 3 are for ease of description only and embodiments regarding the number of horizontal lines and the number of pixel columns are not limited thereto. FIG. 4 is a view illustrating first and second pixels illustrated in FIG. 3.

As illustrated in FIG. 3, the first driving power line VDL is disposed between the $(2p-1)^{th}$ pixel column (where p is a natural number) and the $(2p)^{th}$ pixel column. In some embodiments, the first driving power line VDL is disposed between first and second pixel columns PR1 and PR2. The first driving power line VDL can be disposed between third and fourth pixel columns PR3 and PR4.

A plurality of pixels included in two pixel columns are disposed to correspond to each other with the first driving power line VDL interposed therebetween. The pixels can be defined as first pixels and second pixels as follows. In some embodiments, among the pixels included in the first pixel column PR1, selected pixels from each horizontal line HL1 to HL4 are defined as the first pixels. In some embodiments, among the pixels included in the second pixel column PR2, selected pixels from each horizontal line HL1 to HL4 are defined as the second pixels.

Figure 4:
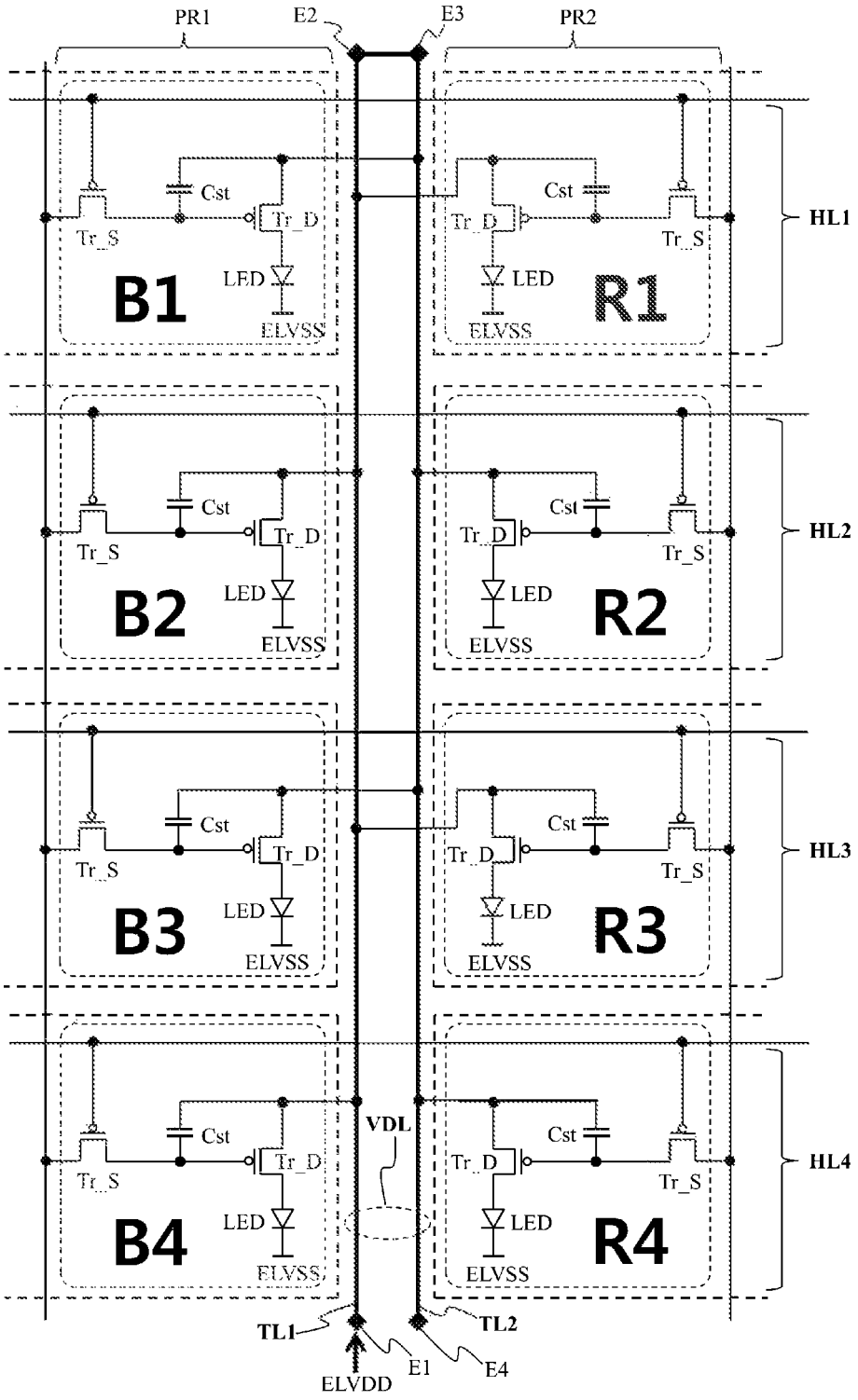
FIG. 4 is a view illustrating first and second pixels illustrated in FIG. 3.

As illustrated in FIG. 4, first to fourth blue pixels B1 to B4 are categorized as the first pixels included in the first pixel column PR1, and first to fourth red pixels R1 to R4 can be categorized as the second pixels included in the second pixel column PR2. Although not illustrated, in another embodiment different from FIG. 4, a first red pixel R1, a second green pixel G1, a third red pixel R3, and a fourth blue pixel B4 are categorized as the first pixels among the pixels included in the first pixel column PR1. Also, in the same embodiment, a first green pixel G1, a blue second pixel B2, a third red pixel R3, and a fourth red pixel R4 are categorized as the second pixels among the pixels included in the second pixel column PR2. The first pixels are not always selected from pixels of the same color. Similarly, the second pixels are not always selected from pixels of the same color.

Referring to FIGS. 3 and 4, the first driving power line VDL can include a first transmission line TL1 and a second transmission line TL2. The first driving voltage ELVDD from the power supply PS can be applied to one side (see E1 of FIG. 4) of the first transmission line TL1. The other side (see E2 of FIG. 4) of the first transmission line TL1 can be connected to one side (see E3 of FIG. 4) of the second transmission line TL2. As illustrated in FIG. 3, there is a bent portion where the first and second transmission lines TL1 and TL2 are connected to each other.

At least one of the first pixels P1 included in the first pixel column PR1 can be connected to the second transmission line TL2 and at least one of the second pixels P2 included in the second pixel column PR2 can be connected to the first transmission line TL1. For example, the first pixels are alternately connected to the first and second transmission lines TL1 and TL2 and the second pixels are alternately connected to the first and second transmission lines TL1 and TL2.

As illustrated in FIG. 4, when the first to fourth blue pixels B1 to B4 among the plurality of pixels included in the first pixel column PR1 are defined as the first pixels. Referring to FIG. 4, the second and fourth blue pixels B2 and B4, which are disposed on the even-numbered horizontal lines HL2 and HL4, are connected to the first transmission line TL1. Referring to FIG. 4, the first and third blue pixels B1 and B3, which are disposed on the odd-numbered horizontal lines HL1 and HL3, are connected to the second transmission line TL2. Further, as illustrated in FIG. 4, when the first to fourth red pixels R1 to R4 included in the second pixel column PR2 are defined as the second pixels, the second and fourth red pixels R2 and R4, which are disposed on the even-numbered horizontal lines HL2 and HL4, are connected to the second transmission line TL2 and the first and third red pixels R1 and R3, which are disposed on the odd-numbered horizontal lines HL1 and HL3, are connected to the first transmission line TL1.

Accordingly, IR drops of the first driving voltage ELVDD can occur at substantially the same level in each horizontal line because of the shapes of the first driving power line VDL and connection structures of the pixels connected to the first driving power line VDL. Further descriptions thereof will be provided with reference to FIGS. 5A and 5B.

Figure 5A:
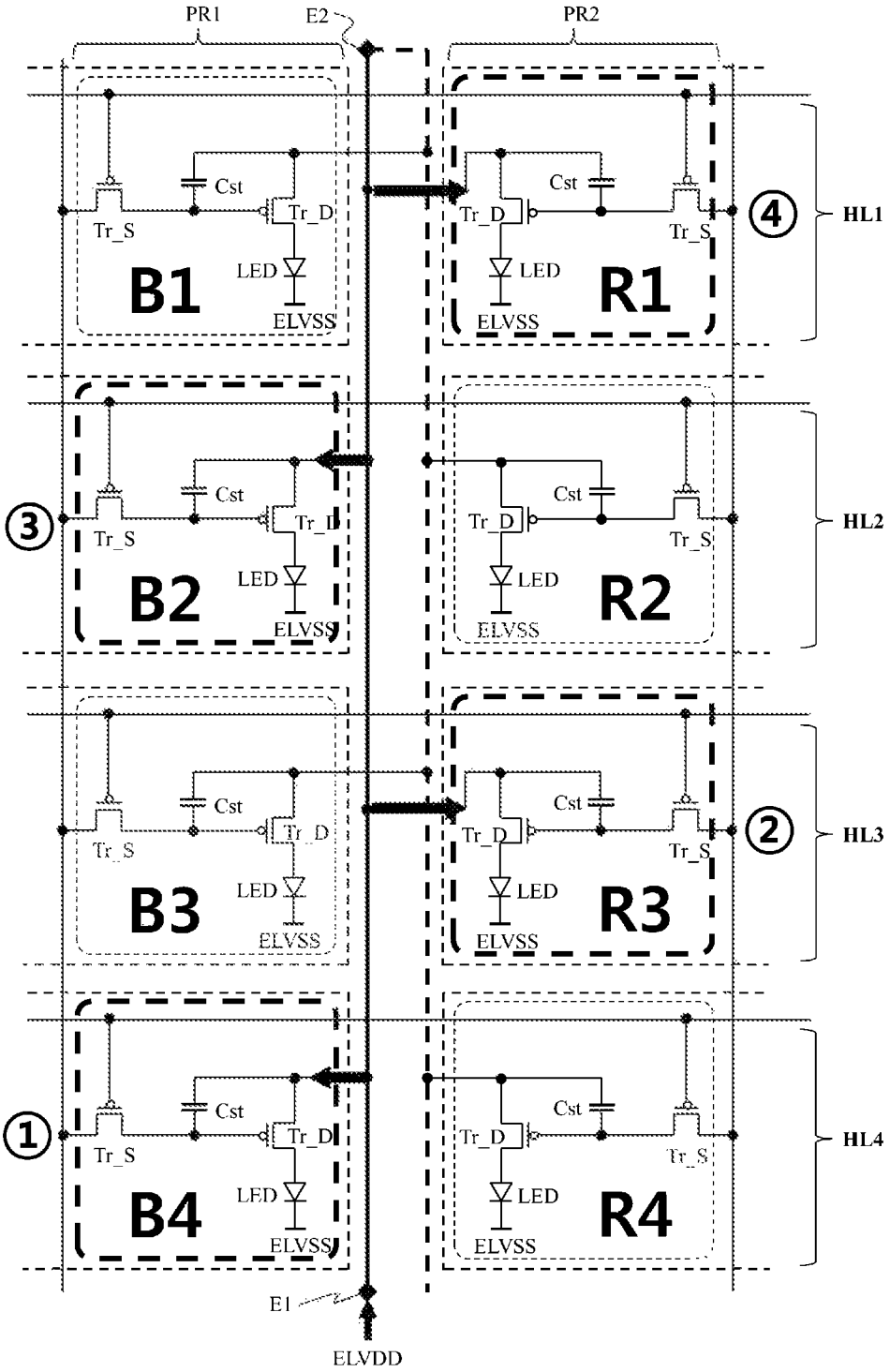
FIGS. 5A and 5B are views illustrating a level of IR drop of a first driving voltage applied to pixels illustrated in FIG. 4.
Figure 5B:
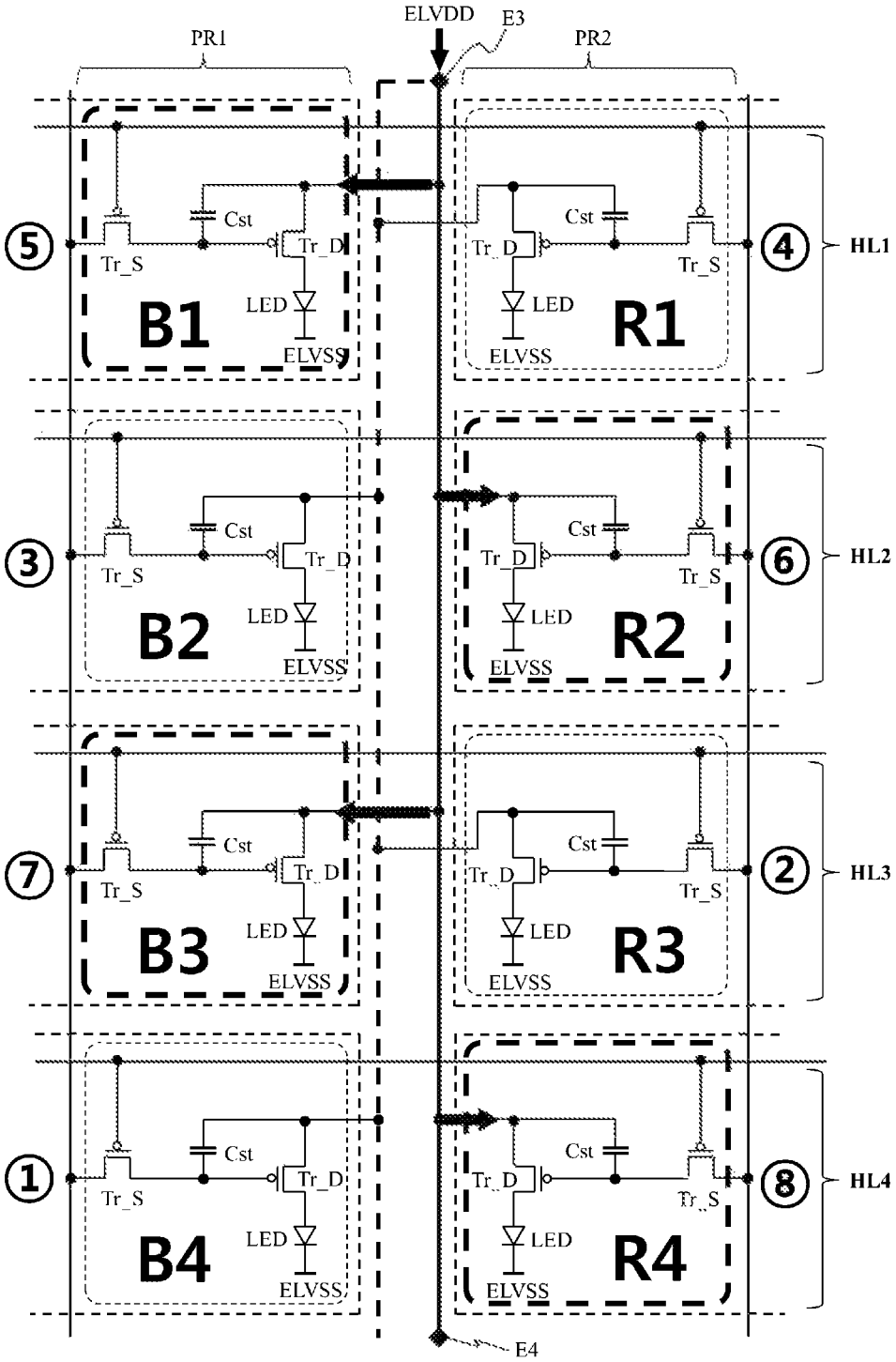

FIGS. 5A and 5B are views illustrating a level of IR drop of the first driving voltage ELVDD applied to the pixels illustrated in FIG. 4.

First, the level of IR drop of the first driving voltage ELVDD applied to pixels connected to the first transmission line TL1 will be described below with reference to FIG. 5A.

As illustrated in FIG. 5A, the first pixels B2 and B4 of the even-numbered horizontal lines HL2 and HL4 and the second pixels R1 and R3 of the odd-numbered horizontal lines HL1 and HL3 are alternately connected to each other between one side (E1) and the other side (E2) of the first transmission line TL1. The first driving voltage ELVDD can be applied to the one side of the first transmission line TL1. Therefore, as a connection of a pixel to the one side of the first transmission line TL1 occurs in a nearer place, the level of IR drop of the first driving voltage ELVDD supplied to the pixel can become lower.

In some embodiments, among the pixels B4, R3, B2, and R1 connected to the first transmission line TL1, which is illustrated in FIG. 5A, the fourth blue pixel B4 is connected closest to the one side (E1) of the first transmission line TL1. Thus, the IR drop of the first driving voltage ELVDD applied to the fourth blue pixel B4 can occur at the lowest level. On the other hand, among the pixels B4, R3, B2, and R1 connected to the first transmission line TL1, the first red pixel R1 can be connected to a place that is the farthest from the one side (E1) of the first transmission line TL1, and thus the IR drop of the first driving voltage ELVDD applied to the first red pixel R1 can occur at the highest level.

In some embodiments, relative levels of the IR drops of all of the pixels B4, R3, B2, and R1 connected to the first transmission line TL1 are as shown in FIG. 5A. For example, when the level of IR drop of the first driving voltage ELVDD applied to the fourth blue pixel B4 is 1(①), the level of IR drop of the first driving voltage ELVDD applied to the third red pixel R3 is 2(②), the level of IR drop of the first driving voltage ELVDD applied to the second blue pixel B2 is 3(③), and the level of IR drop of the first driving voltage ELVDD applied to the first red pixel R1 is 4(④).

Next, the level of IR drop of the first driving voltage ELVDD applied to pixels connected to the second transmission line TL2 will be described below with reference to FIG. 5B.

As illustrated in FIG. 5B, the first pixels B1 and B3 of the odd-numbered horizontal lines HL1 and HL3 and the second pixels R2 and R4 of the even-numbered horizontal lines HL2 and HL4 are alternately connected to each other between one side (E3) and the other side (E4) of the second transmission line TL2. The first driving voltage ELVDD can be applied to the one side (E3) of the second transmission line TL2. Therefore, as a connection of a pixel to the one side of the second transmission line TL2 occurs in a place closer to the one side, the level of IR drop of the first driving voltage ELVDD supplied to the pixel can become lower.

In some embodiments, among the pixels B1, R2, B3, and R4 connected to the second transmission line TL2, which is illustrated in FIG. 5B, the first blue pixel B1 are connected to a place that is the closest to the one side (E3) of the second transmission line TL2. Thus, the IR drop of the first driving voltage ELVDD applied to the first blue pixel B1 can occur at the lowest level. On the other hand, among the pixels B1, R2, B3, and R4 connected to the second transmission line TL2, the fourth red pixel R4 can be connected farthest from the one side (E3) of the second transmission line TL2, and thus the IR drop of the first driving voltage ELVDD applied to the fourth red pixel R4 can occur at the highest level.

In some embodiments, relative levels of the IR drops of all of the pixels B1, R2, B3, and R4 connected to the second transmission line TL2 are as shown in FIG. 5B. For example, when the level of IR drop of the first driving voltage ELVDD applied to the first blue pixel B1 is 5(⑤), the level of IR drop of the first driving voltage ELVDD applied to the second red pixel R2 is 6(⑥), the level of IR drop of the first driving voltage ELVDD applied to the third blue pixel B3 is 7(⑦), and the level of IR drop of the first driving voltage ELVDD applied to the fourth red pixel R4 is 8(⑧).

Therefore, the IR drop of the first driving voltage ELVDD can occur at substantially the same level in each horizontal line HL1 to HL4. As illustrated in FIG. 5B, the sum (⑤+④) of all IR drops of the first driving voltages ELVDD applied to pixels on the first horizontal line HL1, the sum (③+⑥) of all IR drops of the first driving voltages ELVDD applied to pixels on the second horizontal line HL2, the sum (⑦+②) of all IR drops of the first driving voltages ELVDD applied to pixels on the third horizontal line HL3, and the sum (①+⑧) of all IR drops of the first driving voltages ELVDD applied to pixels on the fourth horizontal line HL4 are all about 9.

In some embodiments, the first pixel column PR1 is connected to the first transmission line TL1 along a row and includes two kinds or more pixels that display different colors. As illustrated in FIG. 3, a second unit pixel UPX2 included in the first pixel column PR1 includes a second red pixel R2, a second green pixel G2, and a second blue pixel B2, which display different colors from each other.

Further, the second pixel column PR2 can be connected to the second transmission line TL2 along a row and can include two kinds or more pixels that display different colors. As illustrated in FIG. 3, a sixth unit pixel UPX6 included in the second pixel column PR2 includes a second red pixel R2, a second green pixel G2, and a second blue pixel B2, which display different colors from each other.

Each unit pixel can further include a white pixel that displays a white image. In some embodiments, a first unit pixel UPX1 includes a first red pixel R1, a first green pixel G1, a first blue pixel B1, and a first white pixel.

All pixels included in the same unit pixel can be connected in common to any one of the first and second transmission lines TL1 and TL2. In some embodiments, the first red pixel R1, the first green pixel G1, and the first blue pixel B1, which are included in the first unit pixel UPX1 illustrated in FIG. 3, are connected in common to the second transmission line TL2. For example, all light emitting elements LEDs in all pixels (R1, G1, and B1) included in the first unit pixel UPX1 are connected in common to the second transmission line TL2. Further, the first red pixel R1, the first green pixel G1, and the first blue pixel B1, which are included in a fifth unit pixel UPX5 illustrated in FIG. 3, are connected in common to the first transmission line TL1. For example, all light emitting elements LEDs in all pixels (R1, G1, and B1) included in the fifth unit pixel UPX5 are connected in common to the first transmission line TL1.

In some embodiments, the first and second pixels have a substantially symmetric circuit structure with respect to the first driving power line VDL. Due to the substantially symmetric circuit structure, the light emitting elements LEDs included in the first and second pixels can be all disposed in the vicinity of the first driving power line VDL. Therefore, conductive lines between the light emitting elements LEDs included in the first and second pixels and the first driving power line VDL can be easily disposed. As illustrated in FIG. 4, locations of the driving switching element Tr_D, the data switching element Tr_S, the storage capacitor Cst, and the light emitting element LED in a pixel area of the first blue pixel B1 can be substantially symmetric to locations of the driving switching element Tr_D, the data switching element Tr_S, the storage capacitor Cst, and the light emitting element LED in a pixel area of the first red pixel R1 with respect to the first driving power line VDL. Accordingly, all of the light emitting elements LEDs of the first blue pixel B1 and the first red pixel R1 can be disposed in the vicinity of the first driving power line VDL.

Although not illustrated, all pixels included in one unit pixel can have substantially the same circuit structure. In some embodiments, the first red pixel R1, the first green pixel G1, and the first blue pixel B1 included in the first unit pixel UPX1 illustrated in FIG. 3 all have a circuit structure that is substantially identical to that of the first blue pixel B1 illustrated in FIG. 4. Further, the first red pixel R1, the first green pixel G1, and the first blue pixel B1 included in the fifth unit pixel UPX5 illustrated in FIG. 3 all have a circuit structure that is substantially identical to that of the first red pixel R1 illustrated in FIG. 4.

Figure 6:
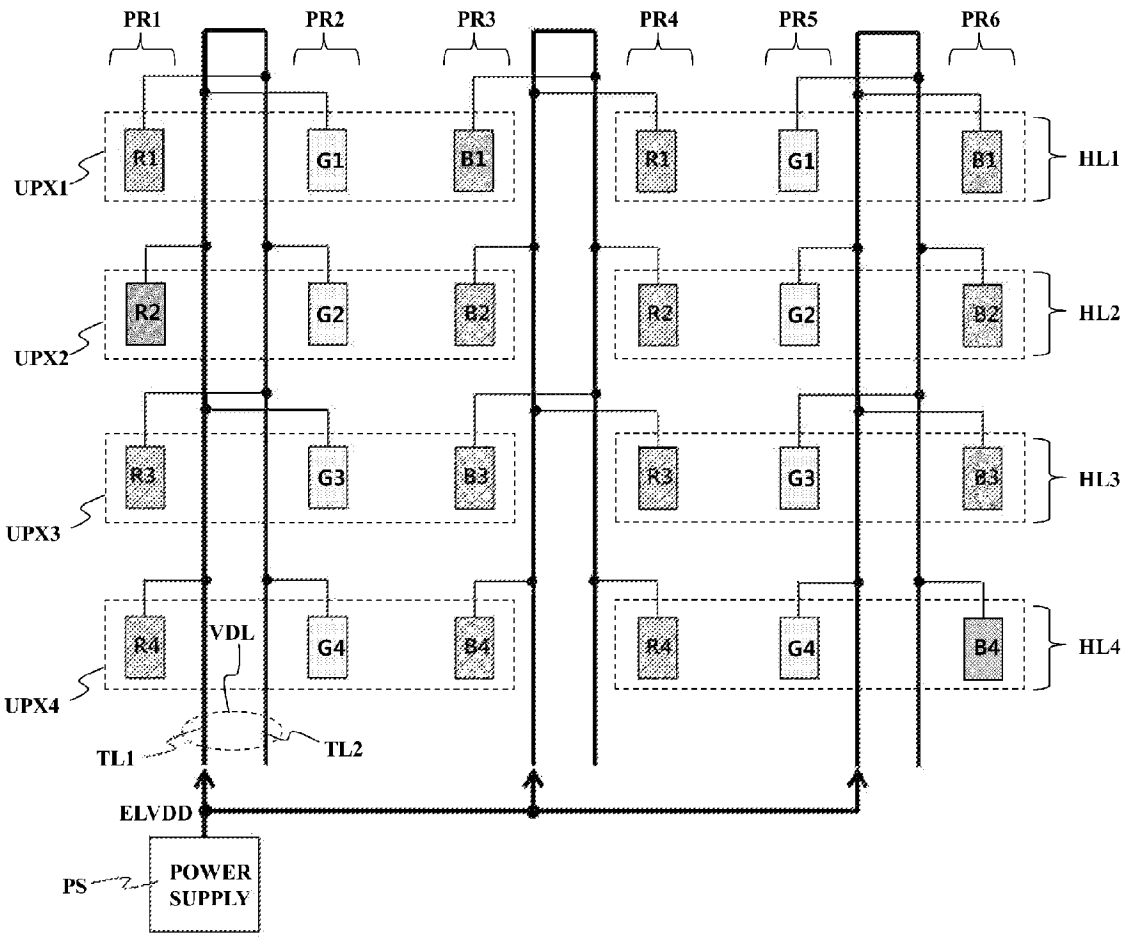
FIG. 6 is a view illustrating a connection between pixels illustrated in FIG. 1 and a first driving power line according to a second embodiment.
Figure 7:
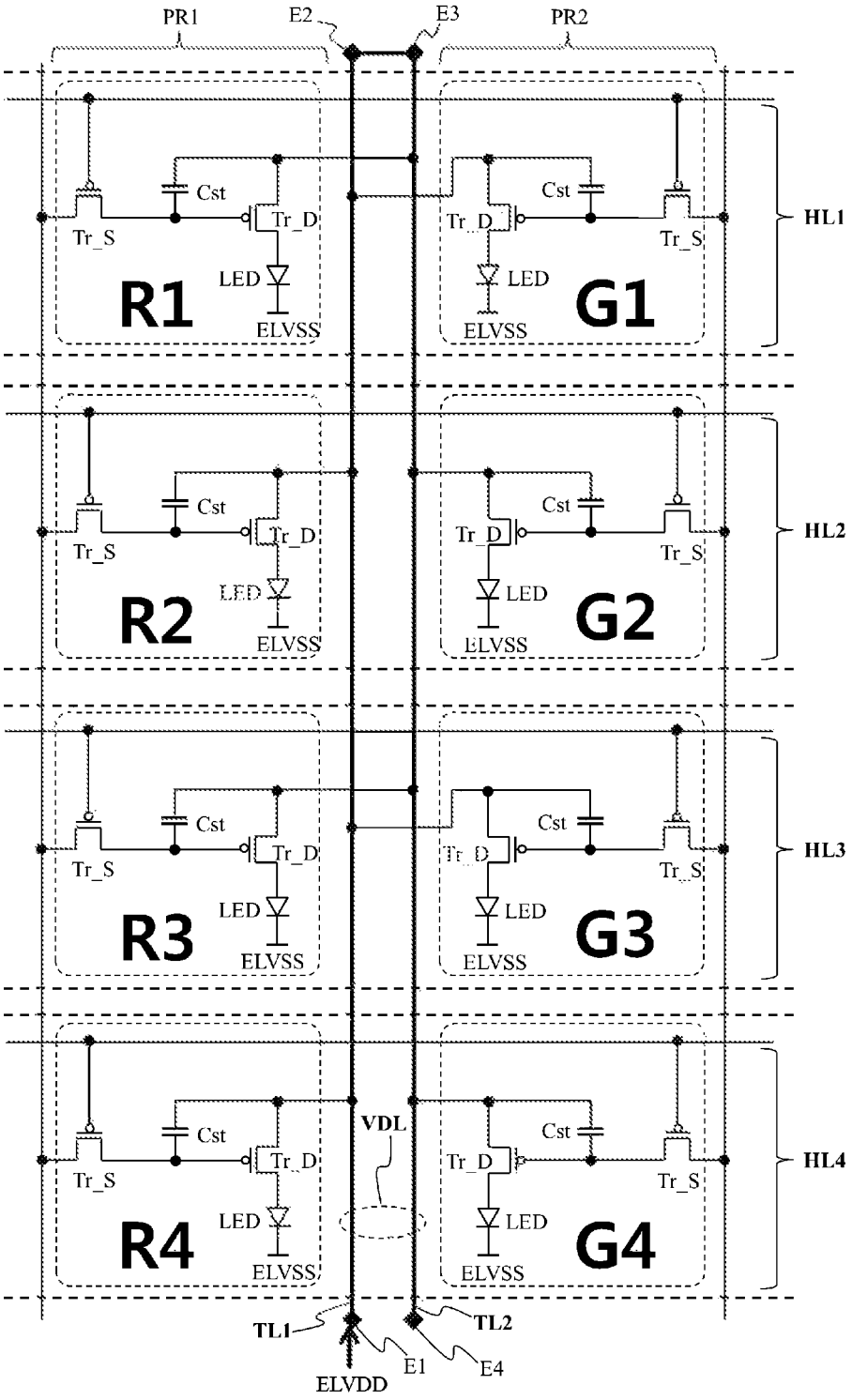
FIG. 7 is a view illustrating first and second pixels illustrated in FIG. 6.

FIG. 6 is a view illustrating a connection between pixels illustrated in FIG. 1 and the first driving power line VDL according to a second embodiment. FIG. 6 illustrates when the total number of horizontal lines of a display area is four and the total number of pixel columns is four. The numbers specified in FIG. 6 are for ease of description only and embodiments regarding the number of horizontal lines and the number of pixel columns are not limited thereto. FIG. 7 is a view illustrating pixels included in a first pixel column and a second pixel column illustrated in FIG. 6.

As illustrated in FIG. 6, the first driving power line VDL is disposed between the $(2\ p-1)^{th}$ pixel column (where p is a natural number) and the $(2\ p)^{th}$ pixel column. In some embodiments, the first driving power line VDL is disposed between first and second pixel columns PR1 and PR2, the first driving power line VDL is disposed between third and fourth pixel columns PR3 and PR4, and the first driving power line VDL is disposed between fifth and sixth pixel columns PR5 and PR6.

The first driving power line VDL can include a first transmission line TL1 and a second transmission line TL2. The first driving voltage ELVDD from the power supply PS can be applied to one side (E1 of FIG. 7) of the first transmission line TL1. The other side (E2 of FIG. 7) of the first transmission line TL1 can be connected to one side (E3 of FIG. 7) of the second transmission line TL2. As illustrated in FIG. 6, a portion where the first and second transmission lines TL1 and TL2 are connected to each other has a bent shape.

At least one of pixels included in the $(2\ p-1)^{th}$ pixel column can be connected to the second transmission line TL2 and at least one of pixels included in the $(2\ p)^{th}$ pixel column can be connected to the first transmission line TL1. The pixels included in the $(2\ p-1)^{th}$ pixel column can be alternately connected to the first and second transmission lines TL1 and TL2 and the pixels included in the $(2\ p)^{th}$ pixel column can be alternately connected to the first and second transmission lines TL1 and TL2.

As illustrated in FIG. 7, among pixels (R1, R2, R3, R4) included in the first pixel column PR1, the second and fourth red pixels R2 and R4 disposed on the even-numbered horizontal lines HL2 and HL4 are connected to the first transmission line TL1. Also, as illustrated in FIG. 7, the first and third red pixels R1 and R3 disposed on the odd-numbered horizontal lines HL1 and HL3 are connected to the second transmission line TL2. Further, as illustrated in FIG. 7, among pixels (G1, G2, G3, G4) included in the second pixel column PR2, the second and fourth green pixels G2 and G4 disposed on the even-numbered horizontal lines HL2 and HL4 are connected to the second transmission line TL2. Also, as illustrated in FIG. 7, the first and third green pixels G1 and G3 disposed on the odd-numbered horizontal lines HL1 and HL3 are connected to the first transmission line TL1.

Accordingly, IR drops of the first driving voltage ELVDD can occur at substantially the same level in each horizontal line because of the shapes of the first driving power line VDL and connection structures of pixels connected to the first driving power line VDL. Further descriptions thereof will be provided with reference to FIGS. 5A and 5B.

In some embodiments, each of two pixel columns facing each other with the first driving power line VDL interposed therebetween includes a plurality of pixels that display substantially the same color. In some embodiments, the first pixel column PR1 illustrated in FIG. 6 includes a plurality of first to fourth red pixels (R1, R2, R3, R4) that display a red color. The second pixel column PR2 illustrated in FIG. 6 includes a plurality of first to fourth green pixels (G1, G2, G3, G4) that display a green color.

Three pixels that are disposed on one horizontal line, display different colors, and are adjacent to each other can be defined as a unit pixel. In some embodiments, a first red pixel R1, a first green pixel G1, and a first blue pixel B1, which are disposed on a first horizontal line HL1, display red, green, and blue colors. They are adjacent to each other and can form a first unit pixel UPX1. In some embodiments, although not illustrated, the first unit pixel UPX1 also includes a first white pixel in addition to the first red pixel R1, the first green pixel G1, and the first blue pixel B1. Further, another unit pixel that is not described herein can also have substantially the same structure as the first unit pixel UPX1.

The pixels included in the two pixel columns facing each other with the first driving power line VDL interposed therebetween can have a substantially symmetric circuit structure with respect to the first driving power line VDL. As an example, pixels of the first and second pixel columns PR1 and PR2 can have a substantially symmetric circuit structure with respect to the first driving power line VDL. Due to the substantially symmetric circuit structure, light emitting elements LEDs included in the pixels of the first and second pixel columns PR1 and PR2 can be all disposed in the vicinity of the first driving power line VDL. Therefore, conductive lines between the light emitting elements LEDs included in the pixels of the first and second pixel columns PR1 and PR2 and the first driving power line VDL can be easily disposed. As illustrated in FIG. 7, locations of the driving switching element Tr_D, the data switching element Tr_S, the storage capacitor Cst, and the light emitting element LED in a pixel area of the first red pixel R1 are substantially symmetric to locations of the driving switching element Tr_D, the data switching element Tr_S, the storage capacitor Cst, and the light emitting element LED in a pixel area of the first green pixel G1 with respect to the first driving power line VDL. Accordingly, all of the light emitting elements LEDs of the first red pixel R1 and the first green pixel G1 can be disposed in the vicinity of the first driving power line VDL.

Figure 8:
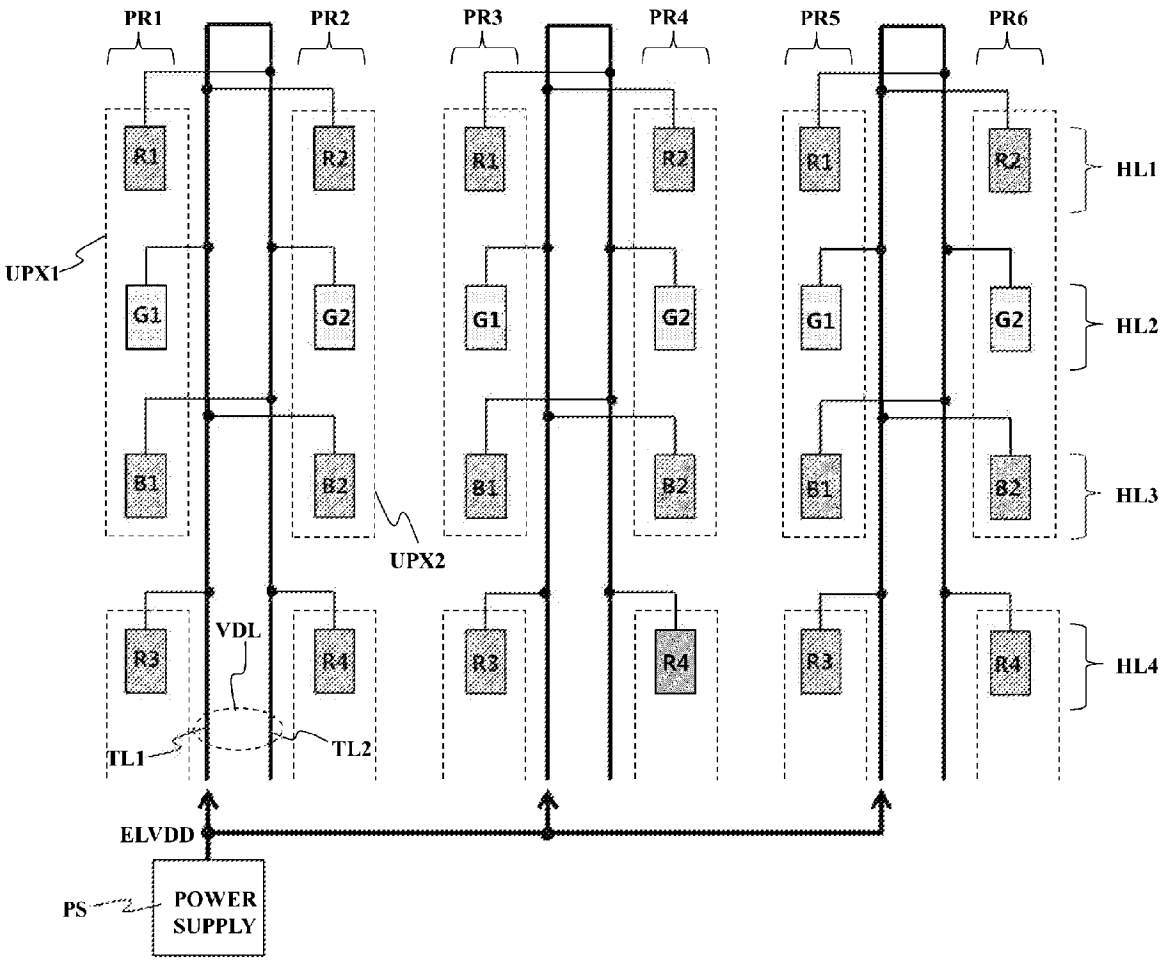
FIG. 8 is a view illustrating a connection between pixels illustrated in FIG. 1 and a first driving power line according to a third embodiment.
Figure 9:
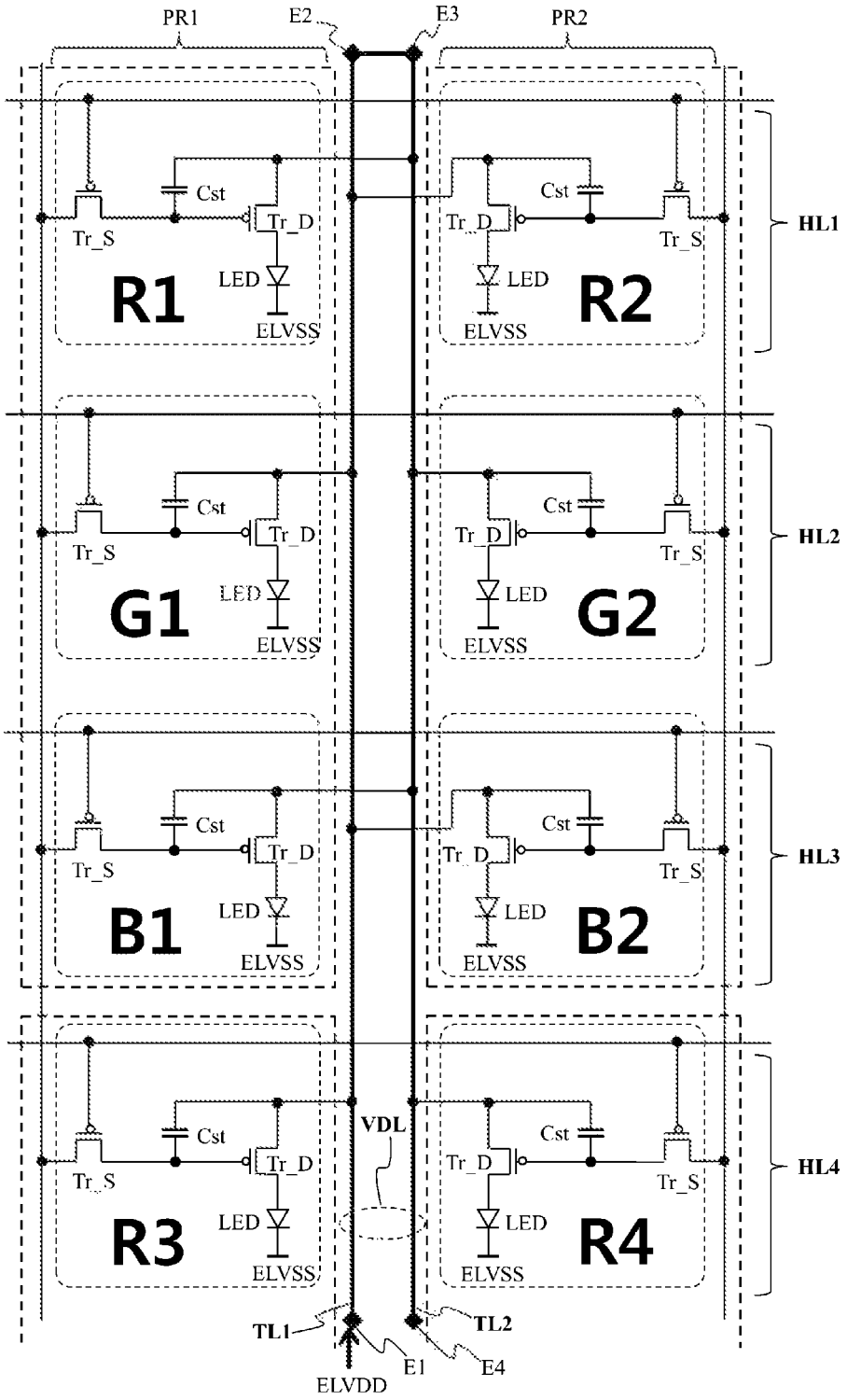
FIG. 9 is a view illustrating pixels of a first pixel column and a second pixel column illustrated in FIG. 8.

FIG. 8 is a view illustrating a connection between pixels illustrated in FIG. 1 and the first driving power line VDL according to a third embodiment. FIG. 8 illustrates when the total number of horizontal lines of a display area is four and the total number of pixel columns is six. The numbers specified in FIG. 8 are for ease of description only and embodiments regarding the number of horizontal lines and the number of pixel columns are not limited thereto. FIG. 9 is a view illustrating pixels of a first pixel column and a second pixel column illustrated in FIG. 8.

As illustrated in FIG. 8, the first driving power line VDL is disposed between the $(2\ p-1)^{th}$ pixel column (where p is a natural number) and the $(2\ p)^{th}$ pixel column. In some embodiments, the first driving power line VDL is disposed between first and second pixel columns PR1 and PR2, the first driving power line VDL is disposed between third and fourth pixel columns PR3 and PR4, and the first driving power line VDL is disposed between fifth and sixth pixel columns PR5 and PR6.

The first driving power line VDL can include a first transmission line TL1 and a second transmission line TL2. The first driving voltage ELVDD from the power supply PS can be applied to one side (see E1 of FIG. 9) of the first transmission line TL1. The other side (see E2 of FIG. 9) of the first transmission line TL1 can be connected to one side (see E3 of FIG. 9) of the second transmission line TL2. As illustrated in FIG. 8, a portion where the first and second transmission lines TL1 and TL2 are connected to each other has a bent shape.

At least one of pixels included in the $(2\ p-1)^{th}$ pixel column can be connected to the second transmission line TL2 and at least one of pixels included in the $(2\ p)^{th}$ pixel column can be connected to the first transmission line TL1. For example, the pixels included in the $(2\ p-1)^{th}$ pixel column are alternately connected to the first and second transmission lines TL1 and TL2, and the pixels included in the $(2\ p)^{th}$ pixel column are alternately connected to the first and second transmission lines TL1 and TL2.

As illustrated in FIG. 9, among pixels (R1, G1, B1, R3) included in the first pixel column PR1, the first green pixel G1 and the third red pixel R3 disposed on the even-numbered horizontal lines HL2 and HL4 are connected to the first transmission line TL1. As illustrated in FIG. 9, the first red pixel R1 and the first blue pixel B1 disposed on the odd-numbered horizontal lines HL1 and HL3 are connected to the second transmission line TL2. Further, as illustrated in FIG. 9, among pixels (R2, G2, B2, R4) included in the second pixel column PR2, the second green pixel G2 and the fourth red pixel R4 disposed on the even-numbered horizontal lines HL2 and HL4 are connected to the second transmission line TL2 and the second red pixel R2. As illustrated in FIG. 9, the second blue pixel B2 disposed on the odd-numbered horizontal lines HL1 and HL3 are connected to the first transmission line TL1.

Accordingly, IR drops of the first driving voltage ELVDD can occur at substantially the same level in each horizontal line because of the shapes of the first driving power line VDL and connection structures of pixels connected to the first driving power line VDL. Further descriptions thereof will be provided with reference to FIGS. 5A and 5B.

In some embodiments, each of two pixel columns facing each other with the first driving power line VDL interposed therebetween includes a plurality of pixels that display different colors. In some embodiments, the first pixel column PR1 illustrated in FIG. 8 includes a plurality of pixels (R1, G1, B1, R3) that display red, green, and blue colors. The second pixel column PR2 illustrated in FIG. 8 includes a plurality of pixels (R2, G2, B2, R4) that display red, green, and blue colors.

Three pixels that are included in one pixel column, display different colors, and are adjacent to each other can be defined as a unit pixel. In some embodiments, a first red pixel R1, a first green pixel G1, and a first blue pixel B1, which are included in the first pixel column PR1, display red, green, and blue colors. They are adjacent to each other and can form a first unit pixel UPX1. In some embodiments, although not illustrated, the first unit pixel UPX1 also includes a first white pixel in addition to the first red pixel R1, the first green pixel G1, and the first blue pixel B1. Further, another unit pixel that is not described herein can also have substantially the same structure as the first unit pixel UPX1.

The pixels included in the two pixel columns facing each other with the first driving power line VDL interposed therebetween can have a substantially symmetric circuit structure with respect to the first driving power line VDL. As an example, pixels of the first and second pixel columns PR1 and PR2 have a substantially symmetric circuit structure with respect to the first driving power line VDL. Due to the substantially symmetric circuit structure, light emitting elements LEDs included in the pixels of the first and second pixel columns PR1 and PR2 are all disposed in the vicinity of the first driving power line VDL. Therefore, conductive lines between the light emitting elements LEDs included in the pixels of the first and second pixel columns PR1 and PR2 and the first driving power line VDL can be easily disposed. As illustrated in FIG. 9, locations of the driving switching element Tr_D, the data switching element Tr_S, the storage capacitor Cst, and the light emitting element LED in a pixel area of the first red pixel R1 can be substantially symmetric to locations of the driving switching element Tr_D, the data switching element Tr_S, the storage capacitor Cst, and the light emitting element LED in a pixel area of the second red pixel R2 with respect to the first driving power line VDL. Accordingly, all of the light emitting elements LEDs of the first red pixel R1 and the second red pixel R2 can be disposed in the vicinity of the first driving power line VDL.

Figure 10:
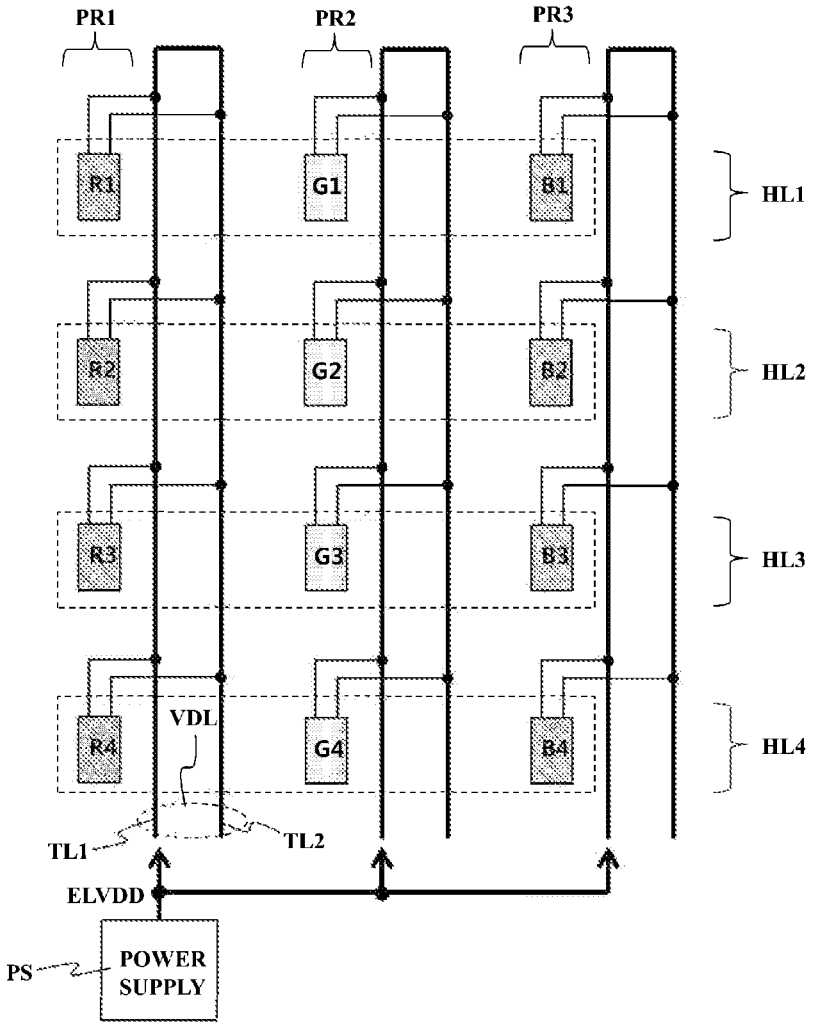
FIG. 10 is a view illustrating a connection between pixels illustrated in FIG. 1 and a first driving power line according to a fourth embodiment.
Figure 11:
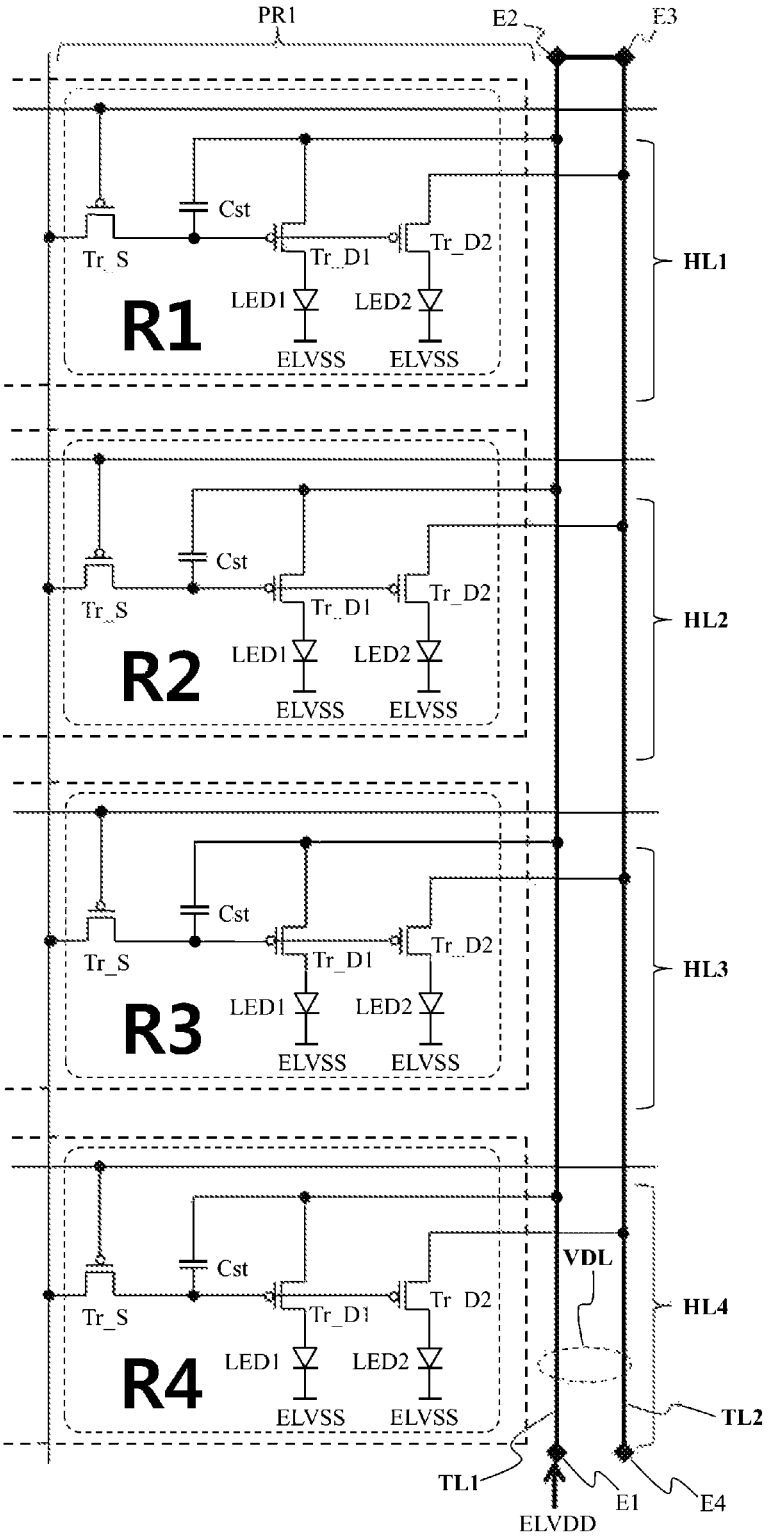
FIG. 11 is a view illustrating a connection structure of pixels of a first pixel column illustrated in FIG. 10 and a first driving power line.

FIG. 10 is a view illustrating a connection between pixels illustrated in FIG. 1 and the first driving power line VDL according to a fourth embodiment. FIG. 10 illustrates when the total number of horizontal lines of a display area is four and the total number of pixel columns is three. The numbers specified in FIG. 10 are for ease of description only and embodiments regarding the number of horizontal lines and the number of pixel columns are not limited thereto. FIG. 11 is a view illustrating a connection structure of pixels of a first pixel column illustrated in FIG. 10 and the first driving power line VDL.

As illustrated in FIGS. 10 and 11, the first driving power line VDL includes a first transmission line TL1 and a second transmission line TL2. The first driving voltage ELVDD from the power supply PS can be applied to one side (see E1 of FIG. 11) of the first transmission line TL1. The other side (see E2 of FIG. 11) of the first transmission line TL1 can be connected to one side (see E3 of FIG. 11) of the second transmission line TL2. As illustrated in FIG. 10, a portion where the first and second transmission lines TL1 and TL2 are connected to each other has a bent shape.

As illustrated in FIGS. 10 and 11, each of a plurality of the pixels included in one pixel column includes two light emitting elements LED1 and LED2. As illustrated in FIG. 11, each pixel (R1, R2, R3, R4) included in the first pixel column PR1 includes first and second light emitting elements LED1 and LED2. For example, each pixel further includes the second light emitting element LED2 and a second driving switching element Tr_D2 when compared to the circuit structure illustrated in FIG. 2. In this case, regarding first and second driving switching elements Tr_D1 and Tr_D2 included in a pixel, gate electrodes thereof Tr_D1 and Tr_D2 can be connected to each other and source electrodes (or drain electrodes) thereof Tr_D1 and Tr_D2 can be connected to different transmission lines. As illustrated in FIG. 11, the first light emitting element LED1 included in the first red pixel R1 is connected to the first transmission line TL1 through the first driving switching element Tr_D1. As illustrated in FIG. 11, the second light emitting element LED2 included in the first red pixel R1 is connected to the second transmission line TL2 through the second driving switching element Tr_D2.

The first transmission line TL1 can supply the first driving voltage ELVDD to the first light emitting element LED1 and the second transmission line TL2 can supply the first driving voltage ELVDD to the second light emitting element LED2.

The first light emitting element LED1 can be connected to a portion between one side (E1) of the first transmission line TL1 and the other side (E2) thereof. The second light emitting element LED2 can be connected to a portion between one side (E3) of the second transmission line TL2 and the other side (E4) thereof.

As illustrated in FIG. 11, the first, second, third, and fourth red pixels R1, R2, R3, and R4 are connected between the one side (E1) and the other side (E2) of the first transmission line TL1. The first driving voltage ELVDD can be applied to the one side (E1) of the first transmission line TL1. Therefore, as a connection of a pixel to the one side of the first transmission line TL1 occurs closer to the one side, IR drop of the first driving voltage ELVDD applied to the pixel can be lower.

In some embodiments, among the pixels (R1, R2, R3, R4) connected between the one side (E1) and the other side (E2) of the first transmission line TL1, the fourth red pixel R4 is connected to the closest place to the one side (E1) of the first transmission line TL1. Thus, the IR drop of the first driving voltage ELVDD applied to the first light emitting element LED1 included in the fourth red pixel R4 can occur at the lowest level. In contrast, among all of the pixels connected to the first transmission line TL1, the first red pixel R1 can be connected to the farthest place from the one side (E1) of the first transmission line TL1, and thus the IR drop of the first driving voltage ELVDD applied to the first light emitting element LED1 included in the first red pixel R1 can occur at the highest level.

In some embodiments, the first, second, third, and fourth red pixels R1, R2, R3, and R4 are connected between one side (E3) of the second transmission line TL2 and the other side (E4) thereof. The first driving voltage ELVDD can be applied to the one side (E3) of the second transmission line TL2. Therefore, as a pixel is connected to a closer place to the one side (E3) of the second transmission line TL2, the IR drop of the first driving voltage ELVDD applied to the pixel can be lower.

In some embodiments, among the pixels (R1, R2, R3, R4) connected between the one side (E3) and the other side (E4) of the second transmission line TL2, the first red pixel R1 is connected to the closest place to the one side (E3) of the second transmission line TL2. Thus, the IR drop of the first driving voltage ELVDD applied to the second light emitting element LED2 included in the first red pixel R1 can occur at the lowest level. In contrast, among all of the pixels (R1, R2, R3, R4) connected to the second transmission line TL2, the fourth red pixel R4 can be connected farthest from the one side (E3) of the second transmission line TL2. Thus, the IR drop of the first driving voltage ELVDD applied to the second light emitting element LED2 included in the fourth red pixel R4 can occur at the highest level.

The total IR drop in a pixel can be calculated from the sum of IR drop of the first driving voltage ELVDD applied to the first light emitting element LED1 included in the pixel and IR drop of the first driving voltage ELVDD applied to the second light emitting element LED2 included in the pixel. In this case, all IR drops in each pixel can be similar to each other.

Figure 12:
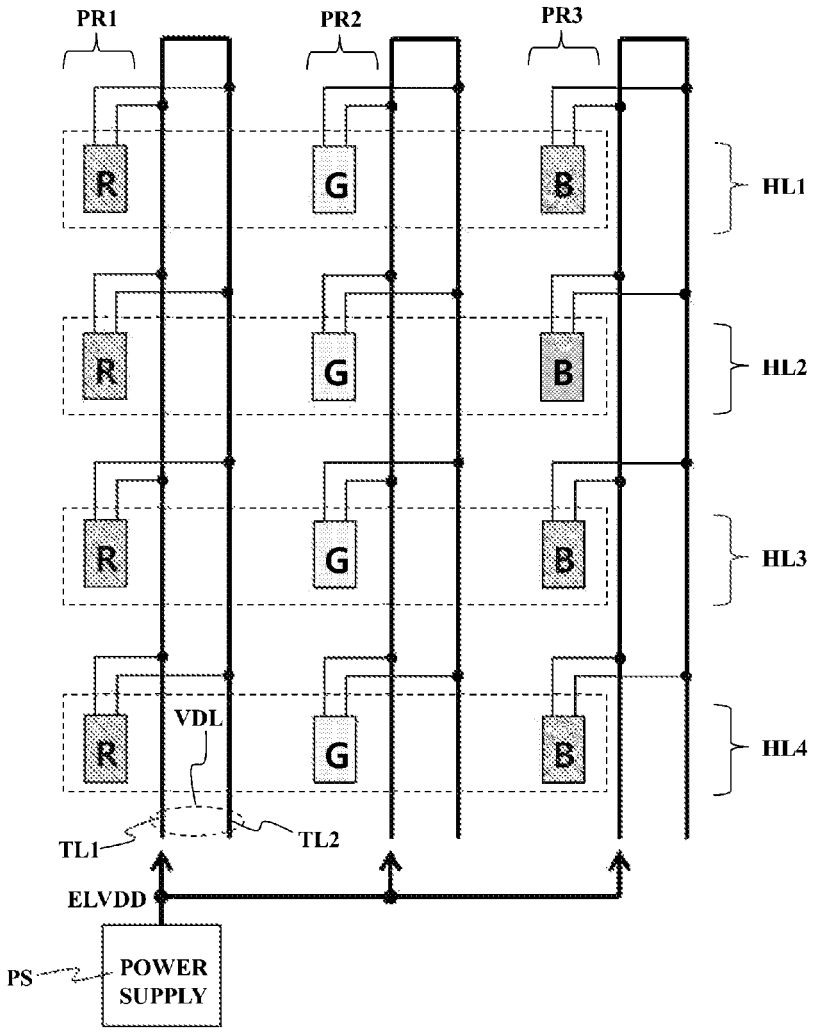
FIG. 12 is a view illustrating a connection between pixels illustrated in FIG. 1 and a first driving power line according to a fifth embodiment.
Figure 13:
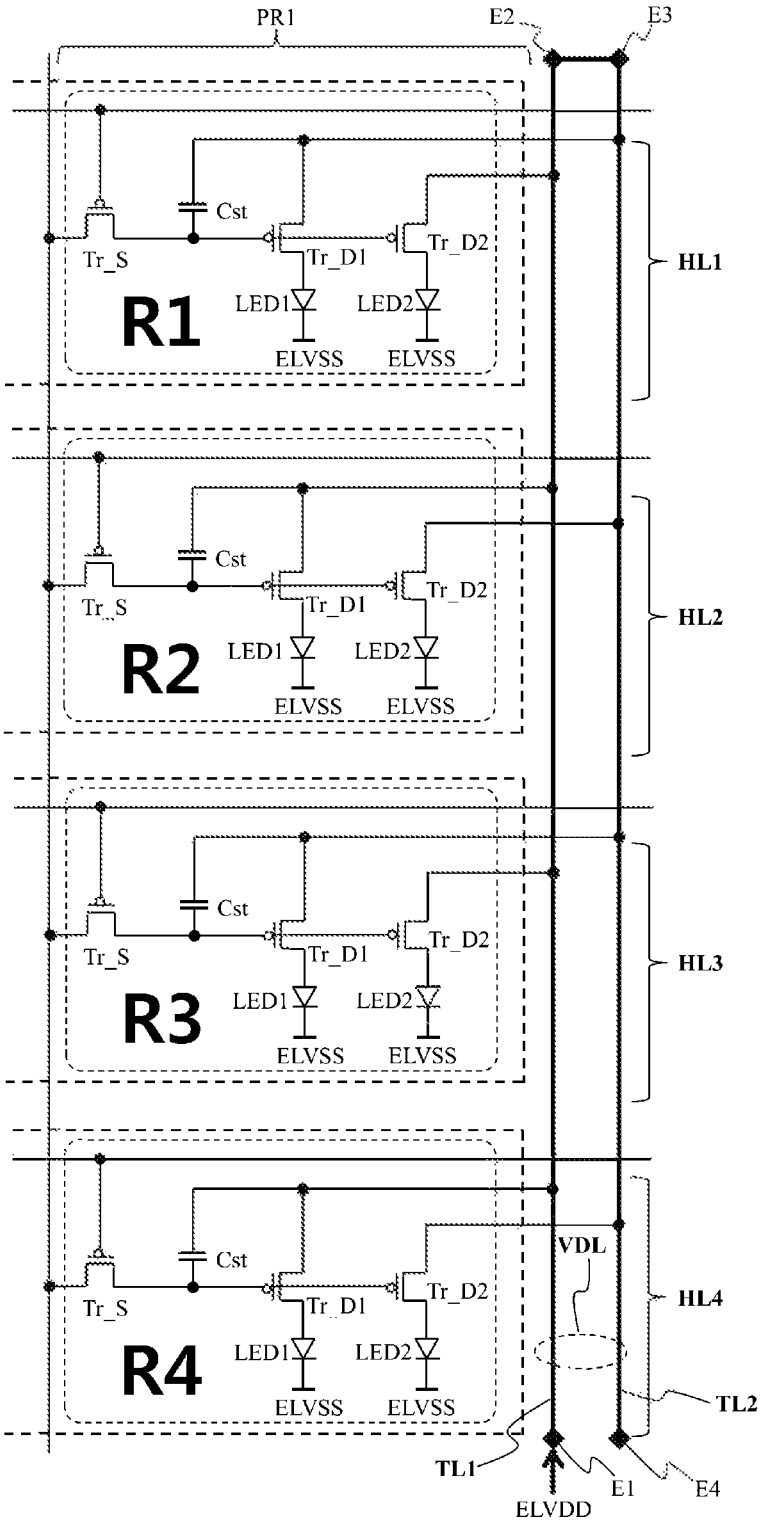
FIG. 13 is a view illustrating a connection structure of pixels of a first pixel column illustrated in FIG. 12 and a first driving power line.

FIG. 12 is a view illustrating a connection between pixels illustrated in FIG. 1 and the first driving power line VDL according to a fifth embodiment. FIG. 12 illustrates when the total number of horizontal lines of a display area is four and the total number of pixel columns is three. The numbers specified in FIG. 12 are for ease of description only and embodiments regarding the number of horizontal lines and the number of pixel columns are not limited thereto. FIG. 13 is a view illustrating a connection structure of pixels of a first pixel column PR1 illustrated in FIG. 12 and a first driving power line VDL.

The circuit structure of the pixels and the first driving power line VDL according to the fifth embodiment are consistent with those of the fourth embodiment, and thus descriptions thereof are omitted herein.

At least one of the first light emitting elements LED1 included in one pixel column can be connected to the second transmission line TL2. At least one of the second light emitting elements LED2 included in the one pixel column can be connected to the first transmission line TL1. For example, the first light emitting elements LED1 of the first pixel column PR1 are alternately connected to the first and second transmission lines TL1 and TL2 and the second light emitting elements LED2 of the first pixel column PR1 are alternately connected to the first and second transmission lines TL1 and TL2.

As illustrated in FIG. 13, the first light emitting elements LED1 included in the pixels R2 and R4 disposed on the even-numbered horizontal lines HL2 and HL4 are connected to the first transmission line TL1. As illustrated in FIG. 13, the first light emitting elements LED1 included in the pixels R1 and R3 disposed on the odd-numbered horizontal lines HL1 and HL3 are connected to the second transmission line TL2. Further, as illustrated in FIG. 13, the second light emitting elements LED2 included in the pixels R2 and R4 disposed on the even-numbered horizontal lines HL2 and HL4 are connected to the second transmission line TL2. As illustrated in FIG. 13, the second light emitting elements LED2 included in the pixels R1 and R3 disposed on the odd-numbered horizontal lines HL1 and HL3 are connected to the first transmission line TL1.

As described above, the shapes of the first driving power line VDL and connection structures of the first and second light emitting elements LED1 and LED2 connected to the first driving power line VDL can enable all IR drops in each pixel to occur at substantially the same level.

Figure 14:
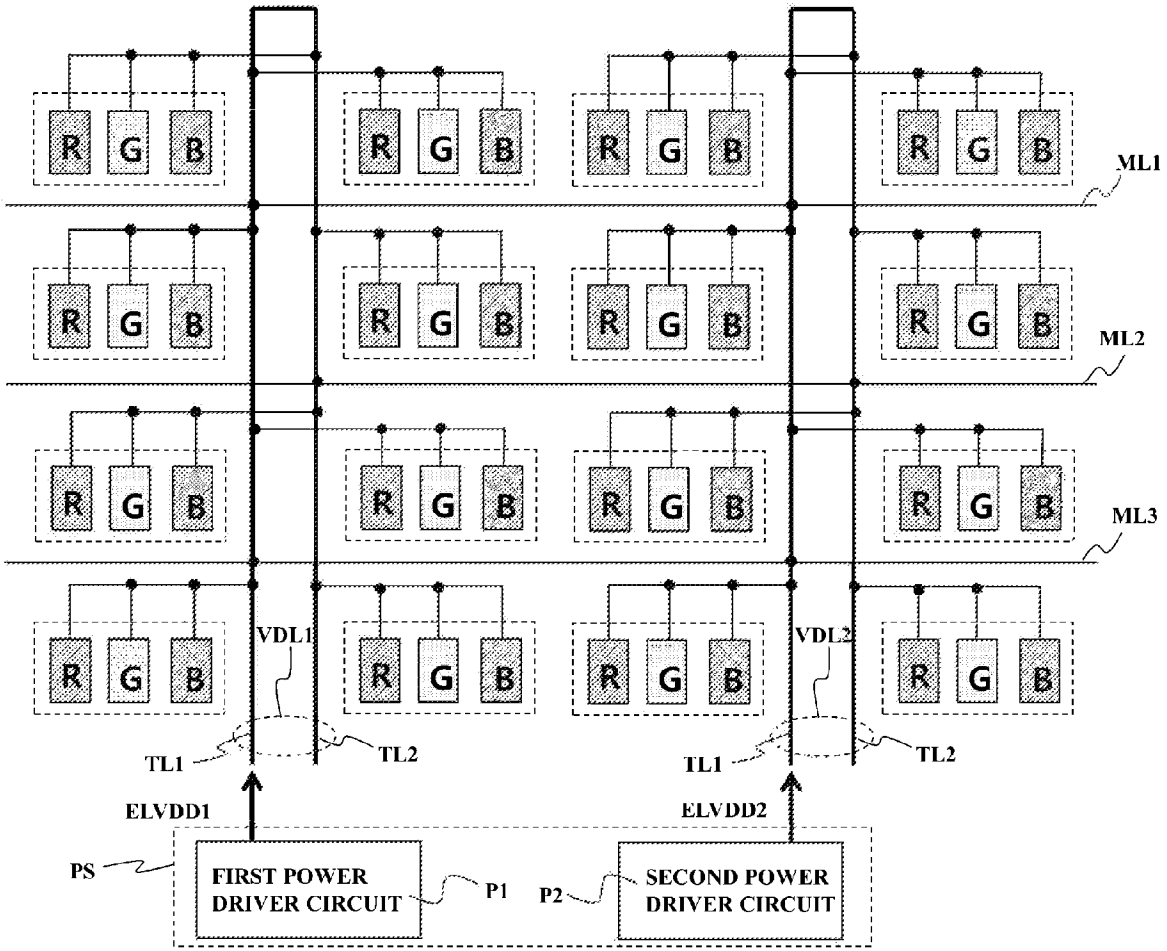
FIG. 14 is a view illustrating another configuration of a power supply illustrated in FIG. 1.

FIG. 14 is a view illustrating another configuration of the power supply PS illustrated in FIG. 1.

The power supply PS, as illustrated in FIG. 14, includes two first power driver circuits P1 and P2 that respectively generate first driving voltages ELVDD1 and ELVDD2. One first power driver circuit P1 can be directly connected to any one of two first driving power lines VDL1 and VDL2 and the other first power driver circuit P2 can be directly connected to the other first driving power line VDL2.

In some embodiments, although not illustrated, when k (k is a natural number greater than 2) first driving power line is provided, the number of first power driver circuits is also k. In this case, each first power driver circuit is individually connected to each first driving power line.

Referring to FIGS. 3, 6, 8, 10, and 12, the power supply PS transmits one first driving voltage ELVDD to all of the first driving power lines VDL. However, the power supply PS illustrated in FIGS. 3, 6, 8, 10, and 12 is replaced with the power supply PS illustrated in FIG. 14.

FIG. 14 shows a plurality of mesh lines ML1, ML2, and ML3 that connect the first driving power lines VDL1 and VDL2 to each other. The first driving voltage ELVDD from the power supply PS can be applied to each one end portion or the other end portion of the mesh lines ML1, ML2, and ML3. The first mesh line ML1 can connect the first transmission lines TL1, the second mesh line ML2 can connect the second transmission lines TL2, and the third mesh line ML3 can connect the first transmission lines TL1. The number of mesh lines can be four or more.

The mesh lines can be applied to the configurations of FIGS. 3, 6, 8, 10, and 12.

From the foregoing, it will be appreciated that various embodiments of the present disclosure have been described herein for purposes of illustration, and that various modifications can be made without departing from the scope and spirit of the present disclosure. Accordingly, the various embodiments disclosed herein are not intended to be limiting, with the true scope and spirit being indicated by the following claims, and equivalents thereof.

What is claimed is:

1. A light emitting element display device comprising:
a first pixel column comprising a plurality of pixels;
a second pixel column comprising a plurality of pixels adjacent to the first pixel column;
a first transmission line disposed between the first and second pixel columns;
a second transmission line disposed substantially parallel to the first transmission line; and
a power supply outputting driving power,
wherein the first and second transmission lines are connected to each other, at least one of the pixels of the first pixel column is connected to the second transmission line, and at least one of the pixels of the second pixel column is electrically connected to the first transmission line,
wherein a driving power line including the first and second transmission lines connected to each other has a U shape, the U shaped driving power line having first and second terminals,
wherein the power supply is connected only to one of the first and second terminals,
wherein the first transmission line is unitary with the second transmission line,
wherein the first terminal is a first end portion of the driving power line, and
wherein the second terminal is a second end portion of the driving power line.

2. The light emitting element display device of claim 1, wherein the pixels of the first pixel column are alternately connected to the first and second transmission lines.

3. The light emitting element display device of claim 1, wherein the pixels of the second pixel column are alternately connected to the first and second transmission lines.

4. The light emitting element display device of claim 1, wherein the first pixel column comprises a plurality of pixels displaying the same color.

5. The light emitting element display device of claim 1, wherein the second pixel column comprises a plurality of pixels displaying the same color.

6. The light emitting element display device of claim 1, wherein the first pixel column comprises a plurality of pixels displaying different colors.

7. The light emitting element display device of claim 6, wherein the first pixel column comprises a first pixel connected to the first transmission line and a second pixel connected to the second transmission line, and the first and second pixels display different colors from each other.

8. The light emitting element display device of claim 1, wherein the second pixel column comprises a plurality of pixels displaying different colors.

9. The light emitting element display device of claim 8, wherein the second pixel column comprises a first pixel connected to the first transmission line and a second pixel connected to the second transmission line, and the first and second pixels display different colors from each other.

10. The light emitting element display device of claim 1, wherein the first pixel column is connected to the first transmission line along a row and comprises two or more kinds of pixels displaying different colors.

11. The light emitting element display device of claim 1, wherein the second pixel column is connected to the second transmission line along a row and comprises two or more kinds of pixels displaying different colors.

12. The light emitting element display device of claim 1, wherein all of the pixels of the first pixel column is located on a first side of the first transmission line.

13. The light emitting element display device of claim 12, wherein all of the pixels of the second pixel column is located on a second side of the first transmission line that is different from the first side.

14. The light emitting element display device of claim 12, wherein each of the first column includes:
a first switching element connected to one of the first and the second transmission lines; and
a second switching element connected to a first data line, wherein a gate electrode of the first switching element is connected to the first data line via the second switching element.

15. The light emitting element display device of claim 12, wherein each of the second column includes:
a third switching element connected to one of the first and the second transmission lines; and a fourth switching element connected to a second data line, wherein a gate electrode of the third switching element is connected to the second data line via the fourth switching element.

* * * * *